US011043170B2

(12) United States Patent
Zhu et al.

(10) Patent No.: US 11,043,170 B2
(45) Date of Patent: Jun. 22, 2021

(54) PIXEL CIRCUIT AND DRIVING METHOD THEREOF, AND DISPLAY APPARATUS

(71) Applicant: Kunshan Go-Visionox Opto-Electronics Co., Ltd., Kunshan (CN)

(72) Inventors: Zhengyong Zhu, Kunshan (CN); Guangyuan Sun, Kunshan (CN); Hui Zhu, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 16/841,692

(22) Filed: Apr. 7, 2020

(65) Prior Publication Data

US 2020/0234652 A1 Jul. 23, 2020

Related U.S. Application Data

(63) Continuation of application No. PCT/CN2019/080183, filed on Mar. 28, 2019.

(30) Foreign Application Priority Data

Sep. 28, 2018 (CN) ..... 201811137019.5

(51) Int. Cl.
*G09G 3/3283* (2016.01)
*G09G 3/3266* (2016.01)

(52) U.S. Cl.
CPC ..... *G09G 3/3283* (2013.01); *G09G 3/3266* (2013.01); *G09G 2320/0233* (2013.01)

(58) Field of Classification Search
CPC ..... G09G 3/3258; G09G 3/3283; G09G 3/30–3291
See application file for complete search history.

(56) References Cited

U.S. PATENT DOCUMENTS

2005/0237273 A1 10/2005 Ozawa et al.
2013/0201172 A1* 8/2013 Jeong ..... G09G 3/3258 345/212

(Continued)

FOREIGN PATENT DOCUMENTS

CN 104575378 A 4/2015
CN 104778926 B 3/2016

(Continued)

OTHER PUBLICATIONS

CN First Office Action dated Feb. 21, 2020 in the corresponding CN application(application No. 201811137019.5).

*Primary Examiner* — Sanjiv D. Patel
(74) *Attorney, Agent, or Firm* — Kilpatrick Townsend & Stockton

(57) ABSTRACT

The present disclosure relates to a pixel circuit, a driving method of a pixel circuit, and a display apparatus. The pixel circuit includes a first transistor, a second transistor, a third transistor, a fourth transistor, a fifth transistor, a sixth transistor, a seventh transistor, a first capacitor and an organic light-emitting diode. A control terminal of the fourth transistor is configured to input a first scanning signal. A first electrode of the fourth transistor is connected to a second electrode of the third transistor, a control terminal of the first transistor and a terminal of the first capacitor. Another terminal of the first capacitor is connected to a second electrode of the second transistor, a second electrode of the fifth transistor and a first electrode of the first transistor.

16 Claims, 6 Drawing Sheets

(56) References Cited

U.S. PATENT DOCUMENTS

| | | | | |
|---|---|---|---|---|
| 2014/0340377 | A1* | 11/2014 | Kishi | G09G 3/3291 345/211 |
| 2016/0171927 | A1 | 6/2016 | Kang | |
| 2017/0169761 | A1* | 6/2017 | Ma | H01L 27/3276 |
| 2017/0316741 | A1* | 11/2017 | Kishi | G09G 3/3258 |
| 2017/0365647 | A1* | 12/2017 | Choi | G09G 3/3233 |
| 2018/0047337 | A1* | 2/2018 | Zhu | G09G 3/3233 |
| 2018/0130410 | A1 | 5/2018 | Gao et al. | |
| 2018/0218681 | A1 | 8/2018 | Cai | |

FOREIGN PATENT DOCUMENTS

| | | | |
|---|---|---|---|
| CN | 105789250 | A | 7/2016 |
| CN | 106157886 | A | 11/2016 |
| CN | 106205495 | A | 12/2016 |
| CN | 106910468 | A | 6/2017 |
| CN | 107274830 | A | 10/2017 |
| CN | 206541596 | U | 10/2017 |
| CN | 109166522 | A | 1/2019 |

* cited by examiner

PIXEL CIRCUIT AND DRIVING METHOD THEREOF, AND DISPLAY APPARATUS

CROSS-REFERENCES TO RELATED APPLICATIONS

The present application is a continuation application of the PCT application No. PCT/CN2019/080183, filed on Mar. 28, 2019 and titled "PIXEL CIRCUIT AND DRIVING METHOD THEREOF, AND DISPLAY APPARATUS", which claims the priority of the Chinese Patent Application No. 201811137019.5, filed on Sep. 28, 2018 entitled "PIXEL CIRCUIT AND DRIVING METHOD THEREOF, AND DISPLAY APPARATUS", and the contents of the both applications are incorporated by reference herein in their entireties.

TECHNICAL FIELD

The present disclosure relates to the field of driving pixels of Organic Light-Emitting Diode (OLED).

BACKGROUND

An organic light-emitting diode display is a display provided with an organic light-emitting diode (OLED) as a light-emitting device. In comparison with a thin film transistor-liquid crystal display (TFT-LCD), the OLED display has advantages of high contrast, wide viewing angle, low power consumption, small thickness, and the like. The brightness level of the OLED is determined by a current generated by driving a thin film transistor (TFT) circuit.

A driving method of a conventional active-matrix organic light emitting diode (AMOLED) includes outputting a data voltage from a data wire, and writing the data voltage into the pixel circuit directly, thereby controlling the brightness of the pixel.

SUMMARY

The various embodiments provided in the present disclosure provide a pixel circuit, a driving method of the pixel circuit, and a display apparatus.

A pixel circuit is provided, including: a transistor $T_1$, a transistor $T_2$, a transistor $T_3$, a transistor $T_4$, a transistor $T_5$, a transistor $T_6$, a transistor $T_7$, a capacitor $C_1$, and an organic light-emitting diode OLED; a control terminal of the transistor $T_4$ is configured to input a first scanning signal; a first electrode of the transistor $T_4$ is connected to a second electrode of the transistor $T_3$, a control terminal of the transistor $T_1$ and a terminal of the capacitor $C_1$; another terminal of the capacitor $C_1$ is connected to a second electrode of the transistor $T_2$, a second electrode of the transistor $T_5$ and a first electrode of the transistor $T_1$; a control terminal of the transistor $T_5$ is configured to input a light-emitting control signal, and a first electrode of the transistor $T_5$ is configured to input a first voltage supply $V_{DD}$; a second electrode of the transistor $T_4$ is configured to input a reference voltage $V_{ref}$, and the second electrode of the transistor $T_4$ is connected to a second electrode of the transistor $T_7$; a control terminal of the transistor $T_2$ is configured to input a second scanning signal, and a first electrode of the transistor $T_2$ is configured to input a data voltage $V_{data}$; a control terminal of the transistor $T_3$ is configured to input the second scanning signal, and a first electrode of the transistor $T_3$ is connected to a second electrode of the transistor $T_1$ and a first electrode of the transistor $T_6$; a control terminal of the transistor $T_6$ is configured to input the light-emitting control signal, and a second electrode of the transistor $T_6$ is connected to a first electrode of the transistor $T_7$; a control terminal of the transistor $T_7$ is configured to input the first scanning signal, and the first electrode of the transistor $T_7$ is connected to an input terminal of the organic light-emitting diode OLED; an output terminal of the organic light-emitting diode OLED is configured to input a second voltage supply $V_{SS}$.

Optionally, the transistor $T_1$, the transistor $T_2$, the transistor $T_3$, the transistor $T_4$, the transistor $T_5$, the transistor $T_6$ and the transistor $T_7$ are p-type transistors.

Optionally, the reference voltage $V_{ref}$ is lower than the second voltage supply $V_{SS}$.

A driving method of the pixel circuit above is provided. The driving method includes: in an initializing phase, setting the first scanning signal to be a low level signal, and setting the second scanning signal to be a high level signal; initializing, by the reference voltage $V_{ref}$, an anode of the organic light-emitting diode OLED and the control terminal of the transistor $T_1$; in a storing phase, setting the first scanning signal and the light-emitting control signal to be high level signals, and setting the second scanning signal to be a low level signal; writing, by the data voltage $V_{data}$, a compensating voltage into the capacitor $C_1$; in a light emitting phase, setting the first scanning signal and the second scanning signal to be high level signals, and setting the light-emitting control signal to be a low level signal; applying the first voltage supply $V_{DD}$ to the organic light-emitting diode OLED, so that the organic light-emitting diode OLED emits light.

Optionally, in the initializing phase, the light-emitting control signal is a high level signal.

Optionally, in the initializing phase, the light-emitting control signal is a low level signal.

Optionally, the initializing phase comprises a first initializing phase and a second initializing phase; in the first initializing phase, setting the first scanning signal and the light-emitting control signal to be low level signals, and setting the second scanning signal to be a high level signal; controlling, by the light-emitting control signal, the transistor $T_5$ and the transistor $T_6$ to turn on; and controlling, by the first scanning signal, the transistor $T_7$ to turn on; in the second initializing phase, setting the first scanning signal to be a low level signal, and setting the second scanning signal and the light-emitting control signal to be high level signals; controlling, by the light-emitting control signal, the transistor $T_5$ and the transistor $T_6$ to be off; and controlling, by the first scanning signal, the transistor $T_7$ to turn on.

Optionally, in the storing phase, the driving method further comprising: controlling, by the light-emitting control signal, the transistor $T_5$ to be off; controlling, by the second scanning signal, the transistor $T_2$ to turn on; and a potential of the first electrode of the transistor $T_1$ being equal to the data voltage $V_{data}$; a potential of the control terminal of the transistor $T_1$ being equal to $V_{data}-|V_{th}|$.

Optionally, in the light emitting phase, the driving method further comprising: controlling, by the light-emitting control signal, the transistor $T_5$ to turn on; controlling, by the first scanning signal, the transistor $T_4$ to be off; and controlling, by the second scanning signal, the transistor $T_3$ to be off; the potential of the first electrode of the transistor $T_1$ being equal to the first voltage supply $V_{DD}$; the potential of the control terminal of the transistor $T_1$ being equal to $V_{data}-|V_{th}|+\eta(V_{DD}-V_{data})$; wherein $\eta$ is a voltage division ratio coefficient determined by a capacitance of the capacitor $C_1$ and a capacitance of capacitor $C_2$, and a sum of the capacitance of the capacitor $C_2$ and the capacitance of the capacitor $C_1$ is an overall capacitance at the control terminal of the transistor $T_1$.

A display apparatus is provided, including the pixel circuit of any one of the above-mentioned embodiments.

In view of the above-mentioned pixel circuit, the driving method of the pixel circuit, and the display apparatus, the pixel circuit includes the transistor $T_1$, the transistor $T_2$, the transistor $T_3$, the transistor $T_4$, the transistor $T_5$, the transistor $T_6$, the transistor $T_7$, the capacitor $C_1$, and the organic light-emitting diode OLED. In the initializing phase, the reference voltage $V_{ref}$ is applied to the anode of the organic light-emitting diode OLED through the transistor $T_7$, thereby realizing the initialization of the anode of the organic light-emitting diode OLED. The reference voltage $V_{ref}$ is applied to the control terminal of the transistor $T_1$ through the transistor $T_4$, thereby initializing the control terminal of the transistor $T_1$. In the light emitting phase, the light-emitting control signal controls the transistor $T_5$ to turn on, the potential of the first electrode of the transistor $T_1$ is changed from the data voltage $V_{data}$ to the first voltage supply $V_{DD}$. The transistor $T_3$ and the transistor $T_4$ are off, the charge of the capacitor $C_1$ remains constant, and the potential of the control terminal of the transistor $T_1$ is changed from $V_{data}-|V_{th}|$ to $V_{data}-|V_{th}|+\eta(V_{DD}-V_{data})$, therefore the coefficient in the formula for the current flowing through the organic light-emitting diode OLED is $(\eta-1)$, wherein $\eta$ is approximate to 1. Therefore there can be a greater difference between the values of the data voltages $V_{data}$ respectively corresponding to adjacent gray scales, thereby solving the technical problem that the gray scales cannot be easily spread.

DETAILED DESCRIPTION OF THE INVENTION

In order to make the objectives, features, and advantages of the present disclosure more apparent and comprehensible, the specified embodiments of the present disclosure will be illustrated in detail in combination with the drawings. The specified details illustrated below facilitate the understanding of the present disclosure. However, the present disclosure can be implemented in many manners other than these described herein. Those skilled in the art can make similar improvements without departing from the contents of the present disclosure. Therefore, the present disclosure is not limited to the specific embodiments disclosed below.

Figure 1:
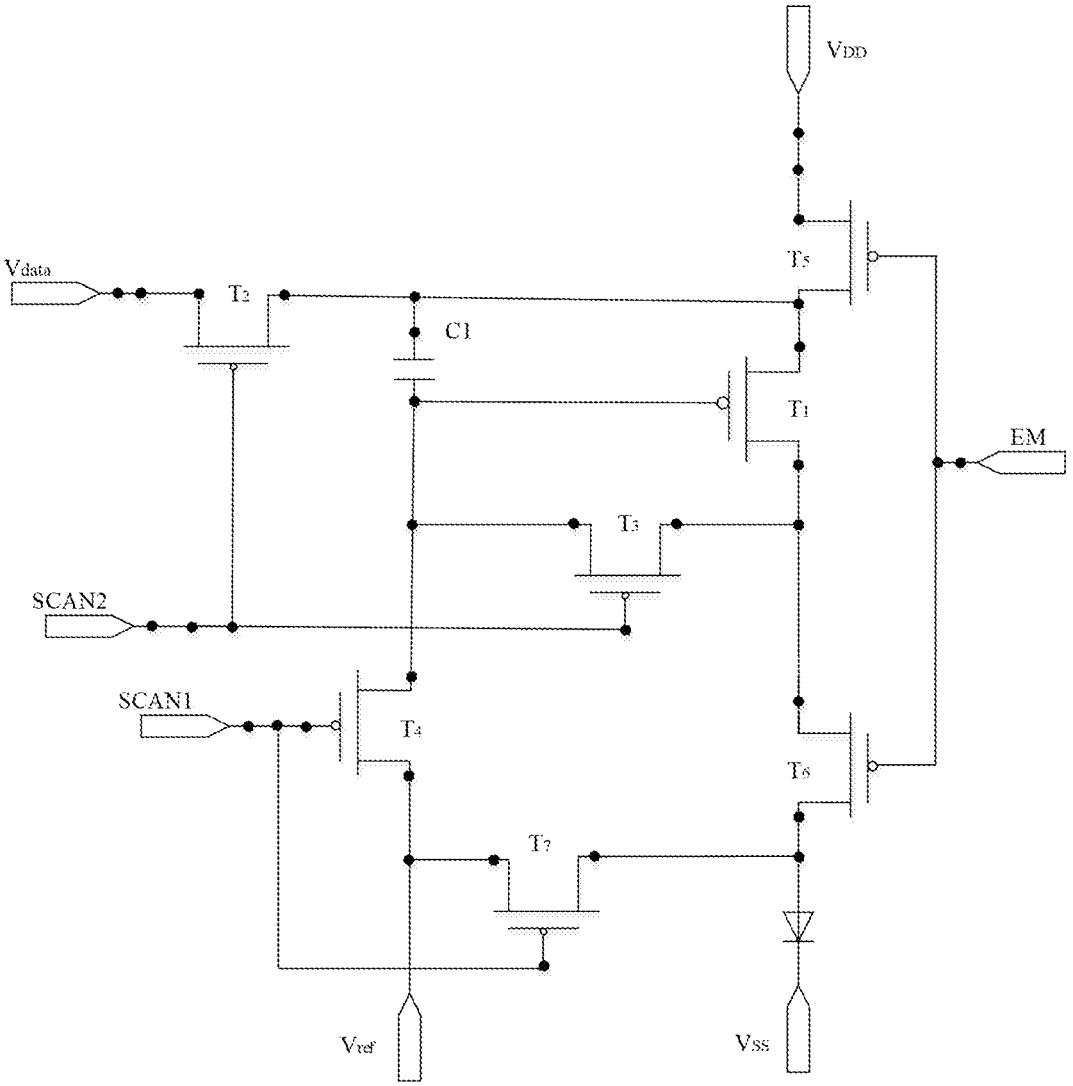
FIG. 1 is a circuit diagram of a pixel circuit of an embodiment of the present disclosure.

In an embodiment, referring to FIG. 1, the present disclosure provides a pixel circuit. The pixel circuit includes a transistor $T_1$, a transistor $T_2$, a transistor $T_3$, a transistor $T_4$, a transistor $T_5$, a transistor $T_6$, a transistor $T_7$, a capacitor $C_1$, and an organic light-emitting diode (OLED). Each transistor from the transistor $T_1$ to the transistor $T_7$ has a control terminal, a first electrode, and a second electrode.

Specifically, a control terminal of the transistor $T_4$ is connected to a first scanning signal terminal, and is configured to input a first scanning signal SCAN1 transmitted through a first scanning signal wire. A first electrode of the transistor $T_4$ is connected to a second electrode of the transistor $T_3$, a control terminal of the transistor $T_1$, and a terminal of the capacitor $C_1$. Another terminal of the capacitor $C_1$ is connected to a second electrode of the transistor $T_2$, a second electrode of the transistor $T_5$, and a first electrode of the transistor $T_1$.

The control terminal of the transistor $T_5$ is connected to a light emitting control terminal, and is configured to input a light-emitting control signal EM transmitted through a light emitting control wire. The first electrode of the transistor $T_5$ is connected to a first power supply, and is configured to input a first voltage supply $V_{DD}$.

The second electrode of the transistor $T_4$ is configured to input a reference voltage $V_{ref}$, and is connected to the second electrode of the transistor $T_7$.

The control terminal of the transistor $T_2$ is configured to input a second scanning signal SCAN2. The first electrode of the transistor $T_2$ is configured to input a data voltage $V_{data}$.

The control terminal of the transistor $T_3$ is connected to a second scanning signal terminal, and is configured to input a second scanning signal SCAN2 transmitted through a second scanning signal wire. The first electrode of the transistor $T_3$ is connected to the second electrode of the transistor $T_1$ and the first electrode of the transistor $T_6$.

The control terminal of the transistor $T_6$ is connected to the light emitting control terminal, and is configured to input the light-emitting control signal EM transmitted through the light emitting control wire. The second electrode of the transistor $T_6$ is connected to the first electrode of the transistor $T_7$.

The control terminal of the transistor $T_7$ is connected to the first scanning signal terminal, and is configured to input the first scanning signal SCAN1 transmitted through the first scanning signal wire. The first electrode of the transistor $T_7$ is connected to the input terminal of the organic light-emitting diode OLED.

The output terminal of the organic light-emitting diode OLED is configured to input a second voltage supply $V_{SS}$.

The transistor $T_2$, transistor $T_3$, transistor $T_4$, transistor $T_5$, transistor $T_6$, and transistor $T_7$ are switching transistors in the pixel circuit. The transistor $T_1$ is a driving transistor in the pixel circuit. The capacitor $C_1$ is an energy storage capacitor, which is connected between the control terminal of the transistor $T_1$ and the first electrode of the transistor $T_1$.

In this embodiment, the first scanning signal SCAN1 controls the transistor $T_4$ and the transistor $T_7$ to turn off or to turn on. The second scanning signal SCAN2 controls the transistor $T_2$ and transistor $T_3$ to turn off or to turn on. The light-emitting control signal EM controls the transistor $T_5$ to turn off or to turn on. The light-emitting control signal EM controls the transistor $T_6$ to turn off or turn on. When the transistor $T_4$ turns on, the reference voltage $V_{ref}$ initializes the control terminal of the transistor $T_1$ through the transistor $T_4$. When the transistor $T_7$ is turned on, the reference voltage $V_{ref}$ initializes the anode of the light-emitting diode OLED through the transistor $T_7$. When the transistor $T_5$ turns on, the electrode plate of the capacitor $C_1$, which is connected to the second electrode of the transistor $T_5$, is initialized. When the transistor $T_2$ and the transistor $T_3$ turn on, the data voltage $V_{data}$ is applied to the gate of the driving transistor $T_1$ through the transistor $T_2$, the transistor $T_1$, and the transistor $T_3$. When the transistor $T_5$ and the transistor $T_6$ turn on, the first voltage supply $V_{DD}$ is applied to the organic light-emitting diode OLED through the transistor $T_5$, the transistor $T_1$, and the transistor $T_6$, so that the organic light-emitting diode OLED emits light.

Optionally, the transistor $T_1$, the transistor $T_2$, the transistor $T_3$, the transistor $T_4$, the transistor $T_5$, the transistor $T_6$, and the transistor $T_7$ can be any one of a low-temperature polysilicon thin film transistor, an oxide semiconductor thin film transistor, and an amorphous silicon thin film transistor. The transistor $T_1$, the transistor $T_2$, the transistor $T_3$, the transistor $T_4$, the transistor $T_5$, the transistor $T_6$, and the transistor $T_7$ can be p-type transistors, or n-type transistors. When the transistor in the pixel circuit is a p-type transistor, a low level signal is input to the control terminal of the transistor which will turn on. When the transistor in the pixel circuit is an n-type transistor, a high level signal is input to the control terminal of the transistor which will turn on.

Figure 2:
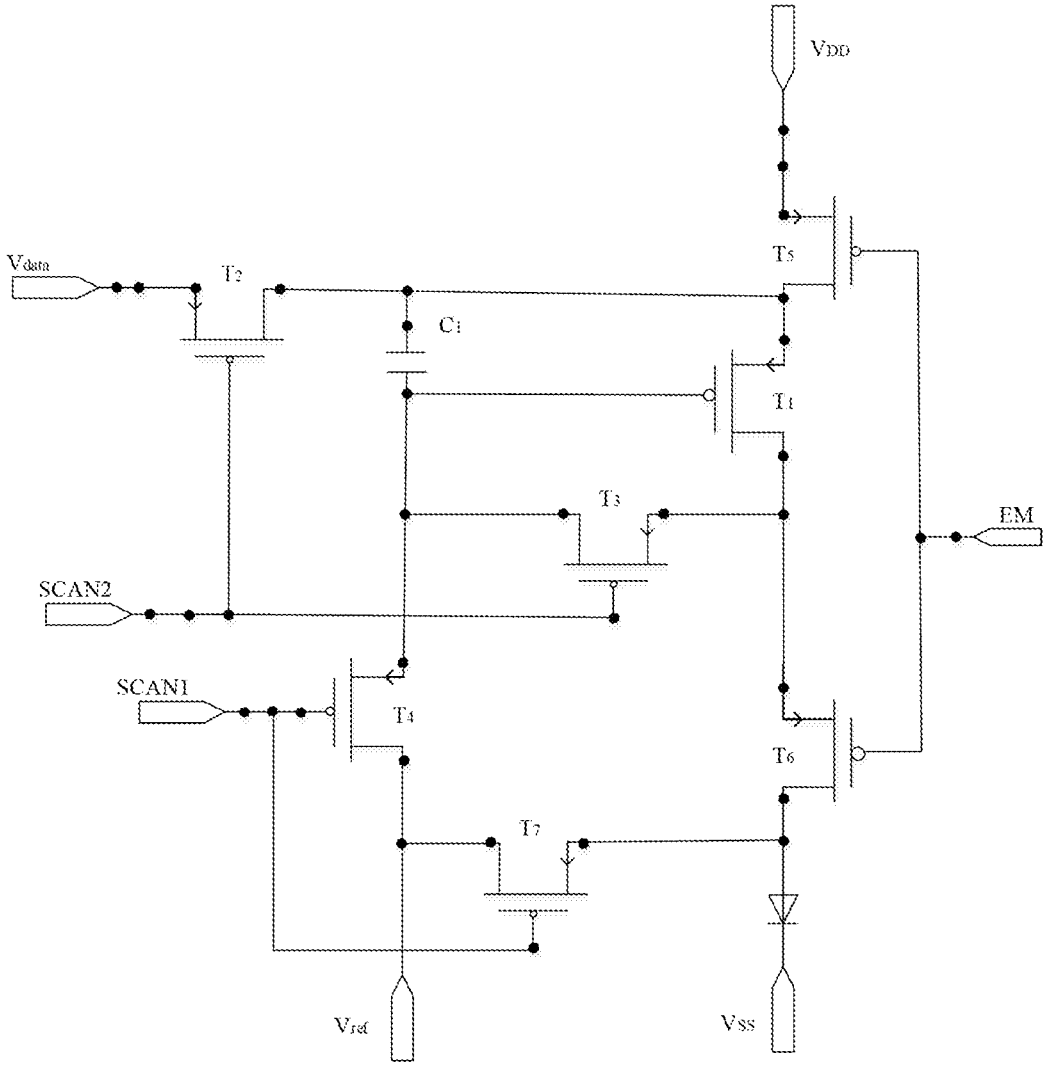
FIG. 2 is a circuit diagram of a pixel circuit with p-type thin film transistors, of an embodiment of the present disclosure.

Referring to FIG. 2, in an embodiment of the pixel circuit provided by the present disclosure, the transistor $T_1$, transistor $T_2$, transistor $T_3$, transistor $T_4$, transistor $T_5$, transistor $T_6$, and transistor $T_7$ are p-type transistors. The control terminals can be gates of the transistor $T_1$ to the transistor $T_7$. The first electrodes can be the sources of the transistor $T_1$ to the transistor $T_7$. The second electrodes can be the drains of the transistor $T_1$ to the transistor $T_7$.

Optionally, the reference voltage $V_{ref}$ is lower than the second voltage supply $V_{SS}$. In a light emitting phase, the first voltage supply $V_{DD}$ is applied to the organic light-emitting diode OLED through the transistor $T_5$, the transistor $T_1$, and the transistor $T_6$, so that the organic light-emitting diode OLED emits light. The forward current flowing through the organic light emitting diode OLED will cause the accumulation of holes and the movement of indium ions in indium tin oxide, accelerating the aging of the organic light emitting diode OLED. In an initializing phase, by means of setting the reference voltage $V_{ref}$ to be lower than the second voltage supply $V_{SS}$, the organic light-emitting diode OLED is biased reversely, thereby compensating the aging caused in the light emitting phase, and prolonging the service life of the organic light-emitting diode OLED.

Optionally, the present disclosure provides a driving method of a pixel circuit based on any one of the above-mentioned embodiments. The driving method sequentially includes the following steps.

In an initializing phase t1, the first scanning signal SCAN1 is a low level signal, and the second scanning signal SCAN2 is a high level signal. The reference voltage $V_{ref}$ is configured to initialize the anode of the organic light-emitting diode OLED and the control terminal of the transistor $T_1$.

In a storing phase t2, the first scanning signal SCAN1 and the light-emitting control signal EM are high level signals, and the second scanning signal SCAN2 is a low level signal. The data voltage $V_{data}$ is configured to write a compensating voltage into the capacitor $C_1$.

In a light emitting phase t3, the first scanning signal SCAN1 and the second scanning signal SCAN2 are both high level signals, and the light-emitting control signal EM is the low level signal. The first voltage supply $V_{DD}$ is configured to be applied to the organic light-emitting diode OLED, so that the organic light-emitting diode OLED emits light.

Figure 3:
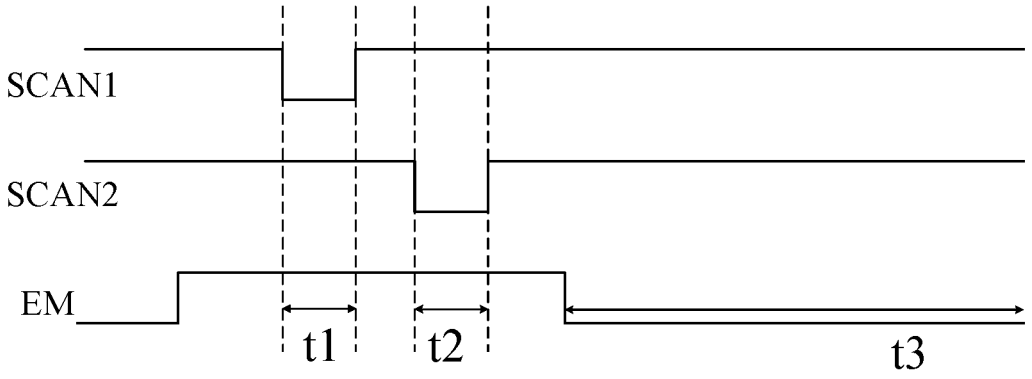
FIG. 3 is a timing diagram of a driving method of an embodiment of the present disclosure.

Referring to FIG. 3, FIG. 3 is a timing graph of signals corresponding to the driving method, wherein the timing graph of signals includes the initializing phase t1, the storing phase t2, and the light emitting phase t3. The working process is specified as follows.

In the initializing phase t1, the first scanning signal SCAN1 is the low level signal, and the transistor $T_1$, the transistor $T_4$, and the transistor $T_7$ turn on. The reference voltage $V_{ref}$ initializes the anode of the organic light-emitting diode OLED and the control terminal of the transistor $T_1$. The potential of the second electrode plate of the capacitor $C_1$, which is connected to the control terminal of the transistor $T_1$, is equal to the reference voltage $V_{ref}$. The second scanning signal SCAN2 is the high level signal, and the transistor $T_2$ and the transistor $T_3$ are off. When the light-emitting control signal EM is a high level signal, the transistor $T_5$ and the transistor $T_6$ are off, and no driving current flows through the organic light-emitting diode OLED, thus the organic light-emitting diode OLED does not emit light. When the light-emitting control signal EM is a low level, the transistor $T_5$ and the transistor $T_6$ turn on. Since the transistor $T_7$ turns on, a current path is formed, and the current path is from a power supply terminal providing the first voltage supply $V_{DD}$, via the transistor $T_5$, the transistor $T_1$, the transistor $T_6$, and the transistor $T_7$, to a power supply terminal providing the reference voltage $V_{ref}$. Moreover, no driving current flows through the organic light-emitting diode OLED, so the organic light-emitting diode OLED does not emit light.

In the storing phase t2, the first scanning signal SCAN1 and the light-emitting control signal EM are both high level signals, and the transistor $T_4$, the transistor $T_5$, the transistor $T_6$, and the transistor $T_7$ are off. The second scanning signal SCAN2 is the low level signal, and the transistor $T_2$ and the transistor $T_3$ turn on. The potential of the first electrode of the transistor $T_1$ is equal to the data voltage $V_{data}$. The potential of the control terminal of the transistor $T_1$ is equal to $V_{data}-|V_{th}|$, wherein $V_{th}$ is a threshold voltage of the transistor $T_1$. Specifically, the light-emitting control signal EM controls the transistor $T_5$ to be off, and the second scanning signal SCAN2 controls the transistor $T_2$ to turn on. The potential of the first electrode of the transistor $T_1$ is equal to the data voltage $V_{data}$. The potential of the control terminal of the transistor $T_1$ is equal to $V_{data}-|V_{th}|$. The first electrode of the transistor $T_1$ is connected to the first electrode plate of the capacitor $C_1$. The control terminal of the transistor $T_1$ is connected to the second electrode plate of the capacitor $C_1$. The potential of the first electrode plate of the capacitor $C_1$ is equal to the data voltage $V_{data}$. The potential of the second electrode plate of the capacitor $C_1$ is equal to $V_{data}-|V_{th}|$, thereby writing the compensating voltage $|V_{th}|$ into the capacitor $C_1$.

In the light emitting phase t3, the first scanning signal SCAN1 and the second scanning signal SCAN2 are both high level signals, and the transistor $T_4$, the transistor $T_7$, the transistor $T_2$ and the transistor $T_3$ are off. The light-emitting control signal EM is the low level signal, and the transistor $T_5$ and the transistor $T_6$ turn on. The first voltage supply $V_{DD}$ is applied to the organic light-emitting diode OLED through the transistor $T_5$, the driving transistor $T_1$, and the transistor $T_6$, so that the organic light-emitting diode OLED emits light.

Specifically, the first electrode plate of the capacitor $C_1$ is connected to the first electrode of the transistor $T_1$, and the second electrode plate of the capacitor $C_1$ is connected to the control terminal of the transistor $T_1$. The light-emitting control signal EM controls the transistor $T_5$ to turn on. The potential of the first electrode plate of the capacitor $C_1$ is equal to the first voltage supply $V_{DD}$. In the storing phase t2, when the potential of the first electrode plate of the capacitor $C_1$ is equal to $V_{data}$, the potential variation value of the first electrode plate of the capacitor $C_1$ is $V_{DD}-V_{data}$. Among overall capacitance at a node of the control terminal of the transistor $T_1$, other capacitance excluding the capacitance of the capacitor $C_1$ is represented by capacitance of a capacitor $C_2$. The voltage division effect of the capacitor $C_2$ further affects the potential of the second electrode plate of the capacitor $C_1$, and the potential of the second electrode plate of the capacitor $C_1$ is equal to $V_{data}-|V_{th}|+\eta(V_{DD}-V_{data})$, wherein $\eta$ is a voltage division ratio coefficient determined by the capacitance of the capacitor $C_1$ and the capacitor $C_2$. The sum of the capacitor $C_2$ and the capacitance of the capacitor $C_1$ is the overall capacitance at the node between the control terminal of the transistor $T_1$ and the capacitor $C_1$.

In this embodiment, the potential of the first electrode of the transistor $T_1$ is changed from the data voltage $V_{data}$ to the first voltage supply $V_{DD}$. The transistor $T_3$ and the transistor $T_4$ are off, and the charge of the capacitor $C_1$ remains constant, and the potential of the control terminal of the transistor $T_1$ is changed from $V_{data}-|V_{th}|$ to $V_{data}-|V_{th}|+\eta(V_{DD}-V_{data})$, therefore the coefficient in the formula for the current flowing through the organic light-emitting diode OLED is $(\eta-1)$, wherein $\eta$ is approximate to 1. Therefore there can be a greater difference between the values of the data voltages $V_{data}$ respectively corresponding to adjacent gray scales. The data voltages corresponding to the adjacent gray scales can be precisely controlled, thereby solving the technical problem that the gray scales cannot be easily spread.

Figure 4:
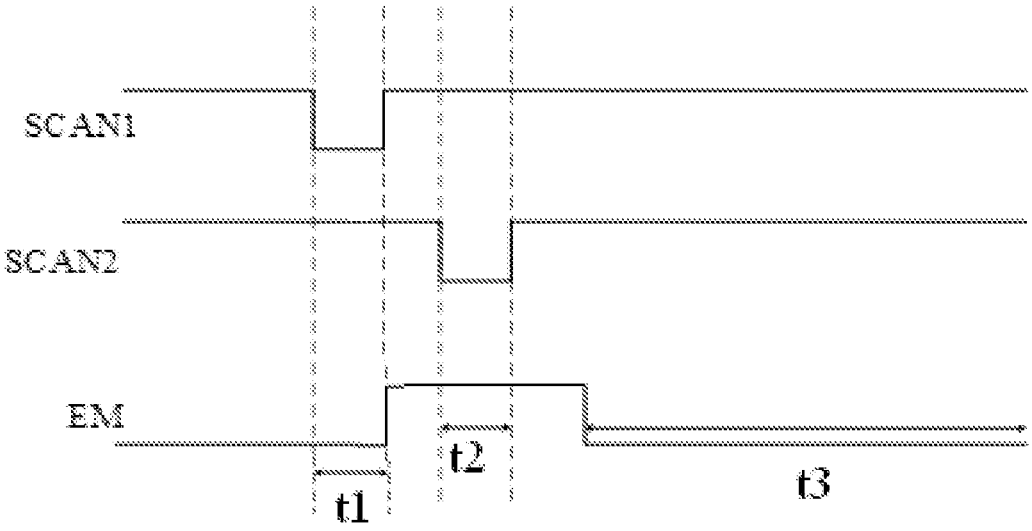
FIG. 4 is a timing diagram of a driving method of an embodiment of the present disclosure.

Optionally, referring to FIG. 4, FIG. 4 is a timing graph of signals corresponding to the driving method, wherein the light-emitting control signal EM is the low level. The timing graph of signals includes the initializing phase t1, the storing phase t2, and the light emitting phase t3. The working process of the initializing phase t1 is as follows.

The first scanning signal SCAN1 is the low level signal, and the transistor $T_1$, the transistor $T_4$, and the transistor $T_7$ turn on. The reference voltage $V_{ref}$ initializes the anode of the organic light-emitting diode OLED and the control terminal of the transistor $T_1$. The potential of the second electrode plate of the capacitor $C_1$, which is connected to the control terminal of the transistor $T_1$, is equal to the reference voltage $V_{ref}$. The second scanning signal SCAN2 is the high level signal, and the transistor $T_2$ and the transistor $T_3$ are off. The light-emitting control signal EM is the low level.

On the one hand, the transistor $T_5$ and the transistor $T_6$ turn on. Since the transistor $T_7$, the transistor $T_5$, and the transistor $T_6$ turn on, a current path is formed, which is from the power supply terminal providing the first voltage supply $V_{DD}$, via the transistor $T_5$, the transistor $T_1$, the transistor $T_6$, and the transistor $T_7$, to the power supply terminal providing the reference voltage $V_{ref}$. Moreover, no driving current flows through the organic light-emitting diode OLED, therefore the organic light-emitting diode OLED does not emit light.

On the other hand, the light-emitting control signal EM controls the transistor $T_5$ to turn on, and the first voltage supply $V_{DD}$ initializes the first electrode plate of the capacitor $C_1$, which is connected to the first electrode of the transistor $T_1$. Therefore, the potential of the first electrode plate of the capacitor $C_1$, which is connected to the second electrode of the transistor $T_5$, is equal to the first voltage supply $V_{DD}$, and the potential of the second electrode plate of the capacitor $C_1$, which is connected to the control terminal of the transistor $T_1$, is equal to the reference voltage $V_{ref}$. Thus it is realized that the capacitor $C_1$ has the same state in time of each image frame after the capacitor $C_1$ is initialized, thereby ensuring the accuracy of the light emitting control.

The working processes of the storing phase t2 and the light emitting phase t3 are the same as the working process corresponding to the timing graph of signals shown in FIG. 3, which will not be described herein repeatedly.

Figure 5:
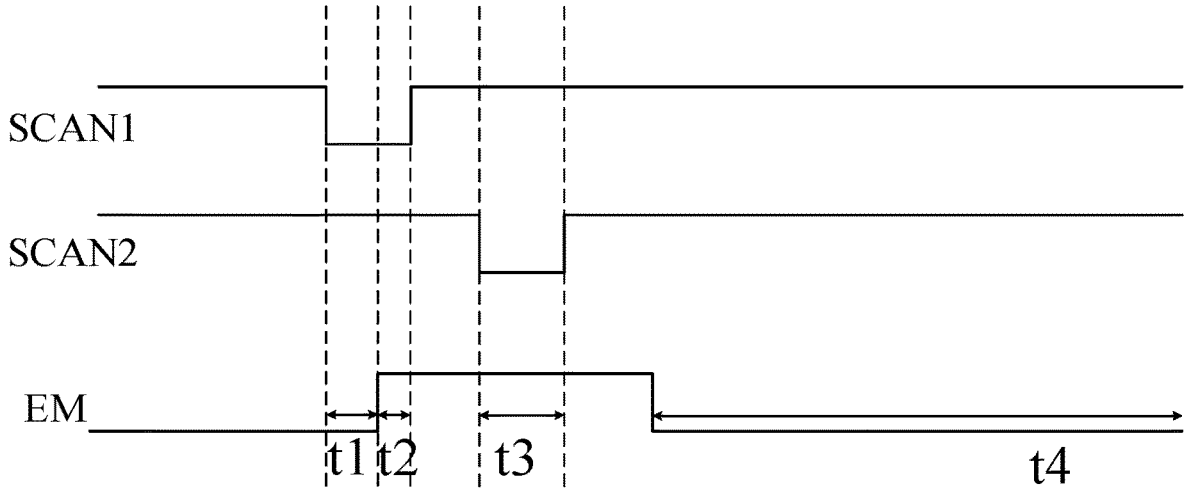
FIG. 5 is a timing diagram of a driving method of an embodiment of the present disclosure.

Optionally, the initializing phase includes a first initializing phase and a second initializing phase. Referring to FIG. 5, FIG. 5 is a timing graph of signals corresponding to the driving method, wherein the timing graph of signals includes the first initializing phase t1, the second initializing phase t2, the storing phase t3, and the light emitting phase t4. The working processes of the first initializing phase t1 and the second initializing phase t2 are as follows.

In the first initializing phase t1, the first scanning signal SCAN1 and the light-emitting control signal EM are both the low level signals, and the second scanning signal SCAN2 is the high level signal. The first scanning signal SCAN1 controls the transistor $T_7$ to turn on, and the light-emitting control signal controls the transistor $T_5$ and the transistor $T_6$ to turn on. Since the transistor $T_7$, the transistor $T_5$, and the transistor $T_6$ turn on, a current path is formed, which is from the power supply terminal providing the first voltage supply $V_{DD}$, via the transistor $T_5$, the transistor $T_1$, the transistor $T_6$, and the transistor $T_7$, to the power supply terminal providing the reference voltage $V_{ref}$. Moreover, the light-emitting control signal EM controls the transistor $T_5$ to turn on, and the first voltage supply $V_{DD}$ initializes the first electrode plate of the capacitor $C_1$, which is connected to the first electrode of the transistor $T_1$. Therefore, the potential of the first electrode plate of the capacitor $C_1$, which is connected to the second electrode of the transistor $T_5$, is equal to the first voltage supply $V_{DD}$, and the potential of the second electrode plate of the capacitor $C_1$, which is connected to the control terminal of the transistor $T_1$, is equal to the reference voltage $V_{ref}$. Thus it is realized that the capacitor $C_1$ has the same state in time of each image frame after the capacitor $C_1$ is initialized, thereby ensuring the accuracy of the light emitting control.

In the second initializing phase, the first scanning signal SCAN1 is the low level signal, and the second scanning signal SCAN2 and the light-emitting control signal EM are both the high level signals. The light-emitting control signal controls the transistor $T_5$ and the transistor $T_6$ to be off. Specifically, in the second initializing phase, the light-emitting control signal EM is changed from the low level signal to the high level signal, thus reducing the time of the current flowing through the transistor $T_5$, the transistor $T_1$, the transistor $T_6$, and the transistor $T_7$, reducing the consumption, and slowing down the aging of the driving transistor $T_1$ as well, thereby prolonging the service life of the driving transistor $T_1$.

The working processes of the storing phase t3 and the light emitting phase t4 are the same as the working processes corresponding to the timing graph of signals shown in FIG. 3, which will not be described herein repeatedly.

Optionally, referring to FIGS. 2 to 5, FIG. 5 is the timing graph of signals corresponding to the driving method, wherein the timing graph of signals includes the first initializing phase t1, the second initializing phase t2, the storing phase t3, and the light emitting phase t4. The working processes are specified as follows.

In the first initializing phase t1, the first scanning signal SCAN1 is the low level signal, and the transistor $T_4$ turns on, and the reference voltage $V_{ref}$ initializes the gate of the transistor $T_1$. The transistor $T_7$ turns on, and the reference voltage $V_{ref}$ initializes the anode of the light-emitting diode OLED. The light-emitting control signal EM is the low level signal, and the transistor $T_5$ and the transistor $T_6$ turn on, and the first voltage supply $V_{DD}$ initializes the first electrode plate of the capacitor $C_1$, which is connected to the source of the transistor $T_1$. Therefore, the potential of the first electrode plate of the capacitor $C_1$, which is connected to the drain of the transistor $T_5$, is equal to the first voltage supply $V_{DD}$, and the potential of the second electrode plate of the capacitor $C_1$, which is connected to the control terminal of the transistor $T_1$, is equal to the reference voltage $V_{ref}$. Thus it is realized that the capacitor $C_1$ has the same state in time of each image frame after the capacitor $C_1$ is initialized, thereby ensuring the accuracy of the light emitting control.

Since the transistor $T_7$, the transistor $T_5$, and the transistor $T_6$ turn on, a current path is formed, which is from the power supply terminal providing the first voltage supply $V_{DD}$, via the transistor $T_5$, the transistor $T_1$, the transistor $T_6$, and the transistor $T_7$, to the power supply terminal providing the reference voltage $V_{ref}$, thereby ensuring the light-emitting diode OLED not to emit light.

In the second initializing phase, the first scanning signal SCAN1 is the low level signal, and the second scanning signal SCAN2 and the light-emitting control signal EM are both the high level signals. The light-emitting control signal controls the transistor $T_5$ and the transistor $T_6$ to be off. Specifically, in the second initializing phase, the light-emitting control signal EM is changed from the low level signal to the high level signal, thus reducing the time of the current flowing through the transistor $T_5$, the transistor $T_1$, the transistor $T_6$, and the transistor $T_7$, reducing the consumption, and slowing down the aging of the driving transistor $T_1$, thereby prolonging the service life of the driving transistor $T_1$.

In the storing phase t2, the first scanning signal SCAN1 and the light-emitting control signal EM are both the high level signals, and the transistor $T_4$, the transistor $T_5$, the transistor $T_6$, and the transistor $T_7$ turn off. The second scanning signal SCAN2 is the low level signal, and the transistor $T_2$ and the transistor $T_3$ turn on. The data voltage $V_{data}$ is applied to the source of the transistor $T_1$ through the transistor $T_2$, till the transistor $T_1$ is in a critical state. The potential of the source of the transistor $T_1$ is equal to the data voltage $V_{data}$, and the potential of the gate of the transistor $T_1$ is equal to $V_{data}-|V_{th}|$. Since the gate of the transistor $T_1$ and the source of the transistor $T_1$ are respectively connected to the two electrode plates of the capacitor $C_1$, the compensating voltage $|V_{th}|$ is written into the capacitor $C_1$.

At this time, the gate voltage of the transistor $T_2$ is $V_{data}-|V_{th}|$, wherein $V_{th}$ is the threshold voltage of the transistor $T_1$, and the value of the threshold voltage is negative, thus the gate voltage of the transistor $T_1$ is $V_{data}+V_{th}$.

In the light emitting phase t3, the first scanning signal SCAN1 and the second scanning signal SCAN2 are both the high level signals, and the transistor $T_4$, the transistor $T_7$ are turned off, the transistor $T_2$ and the transistor $T_3$ turn off. The light-emitting control signal EM is the low level signal, and the transistor $T_5$ and the transistor $T_6$ turn on. The first voltage supply $V_{DD}$ is applied to the organic light-emitting diode OLED through the transistor $T_5$, the driving transistor $T_1$, and the transistor $T_6$, so that the organic light-emitting diode OLED emits light.

The first electrode plate of the capacitor $C_1$ is connected to the source of the transistor $T_1$, and the second electrode plate of the capacitor $C_1$ is connected to the gate of the transistor $T_1$, thus the potential of the first electrode plate of the capacitor $C_1$ is equal to the potential of the source of the transistor $T_1$, and the potential of the second electrode plate of the capacitor $C_1$ is equal to the potential of the gate of the transistor $T_1$. The light-emitting control signal EM controls the transistor $T_5$ to turn on, and the potential of the source of the transistor $T_1$ is equal to the first voltage supply $V_{DD}$, and the potential of the first electrode plate of the capacitor $C_1$ is equal to the first voltage supply $V_{DD}$.

The transistor $T_3$ is off, therefore the charge of the capacitor $C_1$ remains constant, and the voltage difference between the two electrode plates of the capacitor $C_1$ also remains constant, that is, the potential of the first electrode plate of the capacitor $C_1$ varies along with the potential variation of the second electrode plate of the capacitor $C_1$.

In the storing phase t2, the potential of the first electrode plate of the capacitor $C_1$ is equal to $V_{data}$.

Within the time period from the storing phase t2 to the light emitting phase t3, the potential variation value of the first electrode plate of the capacitor $C_1$ is $V_{DD}-V_{data}$.

Among overall capacitance at a node of the gate of the transistor $T_1$, other capacitance excluding the capacitance of the capacitor $C_1$ is represented by capacitance of a capacitor $C_2$. Since the voltage division effect of the capacitor $C_2$ further affects the potential of the second electrode plate of the capacitor $C_1$, the potential of the second electrode plate of the capacitor $C_1$ is equal to $V_{data}+V_{th}+\eta(V_{DD}-V_{data})$.

Wherein $\eta=c_1/(c_1+c_2)$, that is, $\eta$ is a voltage division ratio coefficient determined by the capacitance $c_1$ of the capacitor $C_1$ and the capacitance $c_2$ of the capacitor $C_2$. The sum of the capacitance $c_2$ of the capacitor $C_2$ and the capacitance $c_1$ of the capacitor $C_1$ is the overall capacitance at the node between the control terminal of the transistor $T_1$ and the capacitor $C_1$.

The second electrode plate of the capacitor $C_1$ is connected to the gate of the transistor $T_1$, thus the potential of the gate of the transistor $T_1$ is equal to $V_{data}-|V_{th}|+\eta(V_{DD}-V_{data})$.

The gate-to-source voltage drop of the transistor $T_1$ is:

$$V_{gs}=V_g-V_s;$$

$$V_{gs}=V_{data}+V_{th}+\eta(V_{DD}-V_{data})-V_{DD};$$

$$V_{gs}=(\eta-1)\times(V_{DD}-V_{data})+V_{th}.$$

The driving current flowing through the transistor $T_1$ is:

$$I=K\times(V_{gs}-V_{th})^2=K\times(\eta-1)^2\times(V_{DD}-V_{data})^2,$$

wherein, $K=\frac{1}{2}\times\mu\times C_{ox}\times W/L$; $\mu$ is the electron mobility of the thin-film transistor; $C_{ox}$ is the gate oxide capacitance per unit area of the thin-film transistor; W is the channel width of the thin-film transistor; and L is the channel length of the thin-film transistor.

Therefore, the driving current flowing through the first transistor $T_1$ is:

$$I=\frac{1}{2}\times\mu\times C_{ox}\times W/L\times(\eta-1)^2\times(V_{DD}-V_{data})^2.$$

In view of the above-mentioned equation, a coefficient $(\eta-1)^2$ is introduced in the equation for the current flowing through the organic light-emitting diode OLED, wherein $\eta$ is approximate to 1. Therefore, there can be a greater difference between the data voltages corresponding to adjacent gray scales, thereby solving the technical problem that the gray scales cannot be easily spread. Moreover, the value of the driving current flowing through the transistor $T_1$ is independent of the value of the threshold voltage $V_{th}$ of the transistor $T_1$, thereby realizing the compensation for the threshold voltage, and further making the brightness of the organic light-emitting diode OLED stable.

Figure 6:
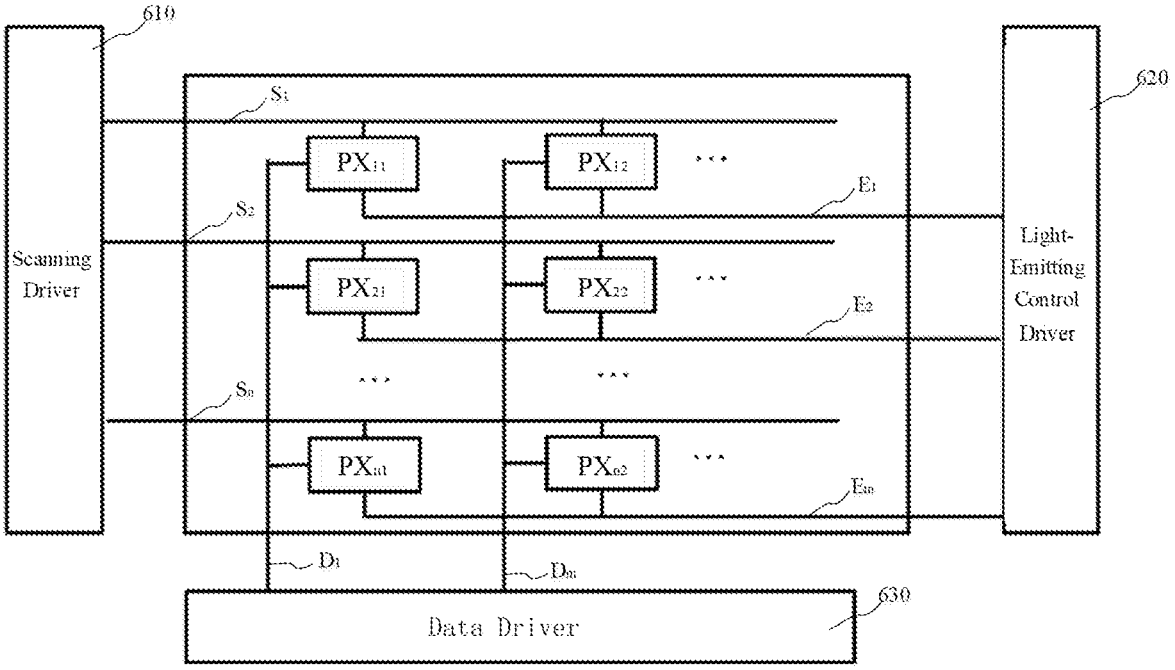
FIG. 6 is a structural diagram of a display apparatus of an embodiment of the present disclosure.

Optionally, the present disclosure provides a display apparatus. Referring to FIG. 6, the display apparatus includes: a plurality of pixels configured to display an image, each pixel including the pixel circuit of any one of the above-mentioned embodiments; a scanning driver 610 sequentially applying scanning signals to each pixel; a light emitting control driver 620 applying light-emitting control signals to each pixel; and a data driver 630 apply data voltages to each pixel.

The pixel receives the data voltage in response to the scanning signal, and the pixel emits light having a predetermined brightness corresponding to the data voltage, to display the image. The time period of light emitting of the pixel is controlled by the light-emitting control signal. The light emitting control driver is initialized in response to the initialization control signal, and generates the light-emitting control signal.

Indicated by making reference to FIG. 6, the scanning driver 610 is connected to a plurality of pixels from $PX_{11}$ to $PX_{nm}$ arranged in a matrix by the scanning signal wires from $S_1$ to $S_n$. The pixels from $PX_{11}$ to $PX_{nm}$ are connected to the light-emitting control signal wires from $E_1$ to $E_m$, and are also connected to the light emitting control driver 620 by the light-emitting control signal wires from $E_1$ to $E_m$. The pixels from $PX_{11}$ to $PX_{nm}$ are also connected to the data signal wires from $D_1$ to $D_m$, and are connected to the data driver 630 through the data signal wires from $D_1$ to $D_m$. The light-emitting control signal wires from $E_1$ to $E_m$ are substantially parallel to the scanning signal wires from $S_1$ to $S_n$. The light-emitting control signal wires from $E_1$ to $E_m$ are substantially perpendicular to the data signal wires from $D_1$ to $D_m$.

All technical features in the embodiments can be arbitrarily combined. For purpose of simplifying the description, not all arbitrary combinations of the technical features in the embodiments illustrated above are described. However, as long as such combinations of the technical features are not contradictory, they should be considered to be within the scope of the specification of the disclosure.

The above embodiments are merely illustrations of several implementations of the disclosure, and the description thereof is more specific and detailed, but should not be deemed as limitations to the scope of the present disclosure. It should be noted that, for those skilled in the art, various deformations and improvements can be made without departing from the concepts of the present disclosure. All these deformations and improvements are within the protection scope of the present disclosure. Therefore, the protection scope of the present disclosure is defined by the appended claims.

The invention claimed is:

1. A pixel circuit comprising: a first transistor, a second transistor, a third transistor, a fourth transistor, a fifth transistor, a sixth transistor, a seventh transistor, a first capacitor, and an organic light-emitting diode;

wherein:

a control terminal of the fourth transistor is configured to input a first scanning signal; a first electrode of the fourth transistor is connected to a second electrode of the third transistor, a control terminal of the first transistor and a terminal of the first capacitor; another terminal of the first capacitor is connected to a second electrode of the second transistor, the second electrode of the second transistor being coupled to a gate terminal of the first transistor via the first capacitor, a second electrode of the fifth transistor and a first electrode of the first transistor;

a control terminal of the fifth transistor is configured to input a light-emitting control signal, the fifth transistor being turned on by the light-emitting control signal at a low level during a first initialization stage, and a first electrode of the fifth transistor is configured to input a first voltage supply;

a second electrode of the fourth transistor is configured to input a reference voltage, and the second electrode of the fourth transistor is connected to a second electrode of the seventh transistor;

a control terminal of the second transistor is configured to input a second scanning signal, and a first electrode of the second transistor is configured to input a data voltage;

a control terminal of the third transistor is configured to input the second scanning signal, and a first electrode of the third transistor is connected to a second electrode of the first transistor and a first electrode of the sixth transistor;

a control terminal of the sixth transistor is configured to input the light-emitting control signal, the sixth transistor being turned on by the light-emitting control signal at a low level during the first initialization stage, and a second electrode of the sixth transistor is connected to a first electrode of the seventh transistor;

a control terminal of the seventh transistor is configured to input the first scanning signal, the seventh transistor being turned on by the first scanning signal at a low level during the first initialization stage, and the first electrode of the seventh transistor is connected to an input terminal of the organic light-emitting diode; and an output terminal of the organic light-emitting diode is configured to input a second voltage supply;

wherein:

in a storing phase, the first scanning signal and the light-emitting control signal are set to high level signals, and the second scanning signal is set a low level signal, and a compensating voltage is written into the first capacitor by the data voltage; and in a light emitting phase, the first scanning signal and the second scanning signal are set to high level signals, and the light-emitting control signal is set to a low level signal, and the first voltage supply is applied to the organic light-emitting diode, to make the organic light-emitting diode emit light.

2. The pixel circuit of claim 1, wherein the first transistor, the second transistor, the third transistor, the fourth transistor, the fifth transistor, the sixth transistor and the seventh transistor are p-type transistors.

3. The pixel circuit of claim 2, wherein the reference voltage is lower than the second voltage supply.

4. A display apparatus, comprising the pixel circuit of claim 1.

5. The driving method of claim 1, wherein at the initializing phase, the light-emitting control signal is a high level signal.

6. The driving method of claim 1, wherein at the initializing phase, the light-emitting control signal is a low level signal.

7. The driving method of claim 1, wherein in the storing phase, the driving method further comprising: controlling the fifth transistor to be off by the light-emitting control signal; controlling the second transistor to turn on by the second scanning signal; and a potential of the first electrode of the first transistor being equal to the data voltage;

a potential of the control terminal of the first transistor being equal to $V_{data}-|V_{th}|$, wherein $V_{data}$ is the data voltage, $|V_{th}|$ is an absolute value of a threshold voltage of the first transistor.

8. The driving method of claim 7, wherein in the light emitting phase, the driving method further comprising: controlling the fifth transistor to turn on by the light-emitting control signal; controlling the fourth transistor to be off by the first scanning signal; and controlling the third transistor to be off by the second scanning signal; the potential of the first electrode of the first transistor being equal to the first voltage supply;

the potential of the control terminal of the first transistor being equal to $V_{data}-|V_{th}|+\eta(V_{DD}-V_{data})$;

wherein $\eta$ is a voltage division ratio coefficient determined by a capacitance of the first capacitor and a capacitance of a second capacitor, and a sum of the capacitance of the second capacitor and the capacitance of the first capacitor is an overall capacitance at the control terminal of the first transistor.

9. The pixel circuit of claim 1 wherein when the second transistor is turned on, a data voltage applied to the gate terminal of the first transistor through the second electrode of the second transistor.

10. A method for driving a pixel circuit, wherein the pixel circuit comprises:

a first transistor, a second transistor, a third transistor, a fourth transistor, a fifth transistor, a sixth transistor, a seventh transistor, a first capacitor, and an organic light-emitting diode;

wherein:

a control terminal of the fourth transistor is configured to input a first scanning signal; a first electrode of the fourth transistor is connected to a second electrode of the third transistor, a control terminal of the first transistor and a terminal of the first capacitor; another terminal of the first capacitor is connected to a second electrode of the second transistor, a second electrode of the fifth transistor and a first electrode of the first transistor;

a control terminal of the fifth transistor is configured to input a light-emitting control signal, and a first electrode of the fifth transistor is configured to input a first voltage supply;

a second electrode of the fourth transistor is configured to input a reference voltage, and the second electrode of the fourth transistor is connected to a second electrode of the seventh transistor;

a control terminal of the second transistor is configured to input a second scanning signal, and a first electrode of the second transistor is configured to input a data voltage;

a control terminal of the third transistor is configured to input the second scanning signal, and a first electrode of the third transistor is connected to a second electrode of the first transistor and a first electrode of the sixth transistor;

a control terminal of the sixth transistor is configured to input the light-emitting control signal, and a second electrode of the sixth transistor is connected to a first electrode of the seventh transistor;

a control terminal of the seventh transistor is configured to input the first scanning signal, and the first electrode of the seventh transistor is connected to an input terminal of the organic light-emitting diode;

an output terminal of the organic light-emitting diode is configured to input a second voltage supply the method comprising a first initializing phase and a second initializing phase, wherein:

in the first initializing phase, setting the first scanning signal and the light-emitting control signal to be low level signals, and setting the second scanning signal to be a high level signal; controlling the fifth transistor and the sixth transistor to turn on by the light-emitting control signal; and controlling the seventh transistor to turn on by the first scanning signal; and in the second initializing phase, setting the first scanning signal to be a low level signal, and setting the second scanning signal and the light-emitting control signal to be high level signals; controlling the fifth transistor and the sixth transistor to be off by the light-emitting control signal; and controlling the seventh transistor to turn on by the first scanning signal.

11. The method of claim 10 further comprising:

in a storing phase, setting the first scanning signal and the light-emitting control signal to be high level signals, and setting the second scanning signal to be a low level signal; writing a compensating voltage into the first capacitor by the data voltage; and in a light emitting phase, setting the first scanning signal and the second scanning signal to be high level signals, and setting the light-emitting control signal to be a low level signal; applying the first voltage supply to the organic light-emitting diode, to make the organic light-emitting diode emit light.

12. The method of claim 11, wherein in the storing phase, the driving method further comprising: controlling the fifth transistor to be off by the light-emitting control signal; controlling the second transistor to turn on by the second scanning signal; and a potential of the first electrode of the first transistor being equal to the data voltage;

a potential of the control terminal of the first transistor being equal to $V_{data}-|V_{th}|$, wherein $V_{data}$ is the data voltage, $|V_{th}|$ is an absolute value of a threshold voltage of the first transistor.

13. The method of claim 12, wherein in the light emitting phase, the driving method further comprising: controlling the fifth transistor to turn on by the light-emitting control signal; controlling the fourth transistor to be off by the first scanning signal; and controlling the third transistor to be off by the second scanning signal; the potential of the first electrode of the first transistor being equal to the first voltage supply;

the potential of the control terminal of the first transistor being equal to $V_{data}-|V_{th}|+\eta(V_{DD}-V_{data})$;

wherein $\eta$ is a voltage division ratio coefficient determined by a capacitance of the first capacitor and a capacitance of a second capacitor, and a sum of the capacitance of the second capacitor and the capacitance of the first capacitor is an overall capacitance at the control terminal of the first transistor.

14. A method for driving a pixel circuit, wherein the pixel circuit comprises a first transistor, a second transistor, a third transistor, a fourth transistor, a fifth transistor, a sixth transistor, a seventh transistor, a first capacitor, and an organic light-emitting diode, the first transistor comprising a control terminal coupled to a first electrode of the fourth transistor, a first electrode coupled to a second terminal of the first capacitor, and a second electrode coupled to a first electrode of the third transistor, the second transistor comprising a control terminal coupled to a second scanning signal, a first electrode coupled to a data voltage, and a second electrode coupled to the second terminal of the first capacitor, the third transistor comprising a control terminal coupled to the second scanning signal, a first electrode coupled to the second electrode of the first transistor, and a second electrode coupled to a first electrode of the fourth transistor, the fourth transistor comprising a control terminal coupled to a first scanning signal, the first electrode coupled to the second electrode of the third transistor, to the control terminal of the first transistor, and to a first terminal of the first capacitor, and a second electrode coupled to a reference voltage, and to a second electrode of the seventh transistor, the fifth transistor comprising a control terminal coupled to a light-emitting control signal, a first electrode coupled to a first voltage supply, and a second electrode coupled to the second terminal of the first capacitor, the sixth transistor comprising a control terminal coupled to the light-emitting control signal, a first electrode coupled to the first electrode of the third transistor, and a second electrode coupled to a first electrode of the seventh transistor, the seventh transistor comprising a control terminal coupled to the first scanning signal, the first electrode coupled to an input terminal of the organic light-emitting diode, a second electrode coupled to the second electrode of the fourth transistor;

the method comprising:

a first initializing phase comprising setting the first scanning signal and the light-emitting control signal to be low level signals, and setting the second scanning signal to be a high-level signal; controlling the fifth transistor and the sixth transistor to turn on by the light-emitting control signal; and controlling the seventh transistor to turn on by the first scanning signal;

a second initializing phase comprising setting the first scanning signal to be a low-level signal, and setting the second scanning signal and the light-emitting control signal to be high level signals; controlling the fifth transistor and the sixth transistor to be off by the light-emitting control signal; and controlling the seventh transistor to turn on by the first scanning signal.

15. The driving method of claim 14 further comprising:

a storing phase comprising setting the first scanning signal and the light-emitting control signal to be high level signals, and setting the second scanning signal to be a low-level signal; writing a compensating voltage into the first capacitor by the data voltage; and a light emitting phase comprising setting the first scanning signal and the second scanning signal to be high level signals, and setting the light-emitting control signal to be a low-level signal; applying the first voltage supply to the organic light-emitting diode, to make the organic light-emitting diode emit light;

wherein in the storing phase, the driving method further comprising: controlling the fifth transistor to be off by the light-emitting control signal; controlling the second transistor to turn on by the second scanning signal; and a potential of the first electrode of the first transistor being equal to the data voltage;

a potential of the control terminal of the first transistor being equal to $V_{data}-|V_{th}|$, wherein $V_{data}$ is the data voltage, $|V_{th}|$ is an absolute value of a threshold voltage of the first transistor.

16. The driving method of claim 15, wherein in the light emitting phase, the driving method further comprising: controlling the fifth transistor to turn on by the light-emitting control signal; controlling the fourth transistor to be off by the first scanning signal; and controlling the third transistor to be off by the second scanning signal; the potential of the first electrode of the first transistor being equal to the first voltage supply;

the potential of the control terminal of the first transistor being equal to $V_{data}-|V_{th}|+\eta(V_{DD}-V_{data})$;

wherein $\eta$ is a voltage division ratio coefficient determined by a capacitance of the first capacitor and a capacitance of a second capacitor, and a sum of the capacitance of the second capacitor and the capacitance of the first capacitor is an overall capacitance at the control terminal of the first transistor.

* * * * *